US006418751B1

(12) United States Patent
Telesz et al.

(10) Patent No.: US 6,418,751 B1
(45) Date of Patent: Jul. 16, 2002

(54) ACCUMULATOR-DEHYDRATOR ASSEMBLY WITH ANTI-BUMP/VENTURI EFFECT OIL RETURN FEATURE FOR AN AIR CONDITIONING SYSTEM

(75) Inventors: John Paul Telesz, East Amherst; Timothy M. Gabel, Tonawanda; Ronald A. Lemmon, Amherst, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/677,633

(22) Filed: Oct. 3, 2000

(51) Int. Cl.[7] ..... F25B 43/00
(52) U.S. Cl. ..... 62/503; 62/471
(58) Field of Search ..... 62/503, 471, 468, 62/470, 474, 500, 509, 512, 298, 85; 210/DIG. 6

(56) References Cited

U.S. PATENT DOCUMENTS

| | | | | | |
|---|---|---|---|---|---|
| 4,270,934 | A | | 6/1981 | Widdowson et al. | 53/316 |
| 4,331,001 | A | * | 5/1982 | Jones | 62/503 |
| 4,509,340 | A | * | 4/1985 | Mullally et al. | 62/503 |
| 4,838,040 | A | * | 6/1989 | Freeman | 62/475 |
| 5,179,844 | A | | 1/1993 | Lyman et al. | 62/503 |
| 5,347,829 | A | | 9/1994 | Newman | 62/474 |
| 5,365,751 | A | | 11/1994 | Mikesell et al. | 62/298 |
| 5,660,058 | A | | 8/1997 | Harris et al. | |
| 5,778,697 | A | | 7/1998 | Wantuck | 62/503 |
| 5,906,112 | A | * | 5/1999 | Amin et al. | 62/503 |

FOREIGN PATENT DOCUMENTS

SU 1291-795 A 2/1987

* cited by examiner

*Primary Examiner*—Chen-Wen Jiang
(74) *Attorney, Agent, or Firm*—Patrick M. Griffin

(57) ABSTRACT

An accumulator-dehydrator for use in an air conditioning system having a delivery tube that has an unobstructed free end for drawing in vaporized refrigerant and an oil pickup tube for drawing in oil and liquid refrigerant into the hollow delivery tube. The hollow delivery tube includes a venturi portion, which creates the draw necessary to pull the oil and liquid refrigerant into the hollow delivery tube. An equalization hole is also provided to prevent a liquid slug from migrating to the compressor, thereby damaging the compressor.

10 Claims, 1 Drawing Sheet

ACCUMULATOR-DEHYDRATOR ASSEMBLY WITH ANTI-BUMP/VENTURI EFFECT OIL RETURN FEATURE FOR AN AIR CONDITIONING SYSTEM

TECHNICAL FIELD

This invention relates to an accumulator-dehydrator assembly for an air conditioning system. This invention specifically relates to an accumulator-dehydrator that eliminates the traditional J-shaped tube inside the accumulator-dehydrator and replaces the J-shaped tube with an inline trumpet tube which will not fill up with liquid and which utilizes an oil siphoning system to provide oil return to the compressor.

BACKGROUND OF THE INVENTION

Vehicle air conditioning systems include a compressor that compresses and superheats refrigerant, which then runs through a condenser, expander and evaporator in turn before returning to the compressor to begin the cycle again. Entrained within the refrigerant is a small amount of lubricating oil, which is needed to ensure smooth performance and prolong the life of the compressor.

Interposed between the evaporator and compressor is an accumulator-dehydrator which is designed to accomplish several objectives. The accumulator-dehydrator primarily receives and accumulates the evaporator effluent. The evaporator effluent typically includes both a liquid component and a vapor component. The accumulator-dehydrator serves as a reservoir or separator in which liquid collects at the bottom of the reservoir and vapor collects at the top. The accumulator-dehydrator ensures that only refrigerant in a vapor stage passes to the compressor. The accumulator-dehydrator also prevents a liquid slug from being pulled or sucked into the compressor. Still further, a desiccant is typically located in the bottom of the accumulator-dehydrator to absorb any water in the refrigerant.

Traditionally accumulator-dehydrators are known to use a U-shaped or J-shaped tube more commonly known as a J-tube. The accumulator-dehydrator is fundamentally a canister with inlet and outlet fittings. The inlet fitting is connected to the evaporator. The refrigerant enters the inlet as a vapor and liquid mixture. The liquid drops to the bottom of the canister and the vapor rises to the top. The J-tube is connected at one end to the canister outlet, which in turn is connected to the compressor. The J-tube extends down from the outlet to adjacent the bottom of the canister and then turns upward and extends to adjacent the top of the canister. The free end of the J-tube, the portion near the canister top, is open to allow the refrigerant vapor to be drawn into the J-tube and exit through the outlet fitting to the compressor. A small opening is provided in the bottom turn-portion or U-portion of the J-tube to allow the liquid including the oil, to enter the J-tube and be entrained and delivered with the refrigerant vapor to the compressor.

With traditional J-tube accumulator-dehydrators and the compressor disengaged (no flow through the J-tube), the J-tube will fill with liquid to the same level as the liquid in the canister. When the compressor is engaged a large pressure differential quickly occurs across the liquid stored in the J-tube. This large pressure differential causes the liquid in the J-tube to accelerate rapidly and to violently boil off. This rapid liquid acceleration and boiling imparts energy to the accumulator-dehydrator, which is classified as "bump" energy. This "bump" energy is present in all traditional J-tube accumulator-dehydrators. This energy manifests itself as a broad frequency noise known as the "bump".

The energy imparted to the accumulator-dehydrator is a function of the rate of pressure drop across the liquid level in the J-tube within the accumulator-dehydrator and the amount of liquid in the J-tube. The pressure drop is affected by the compressor displacement, compressor drive ratio, and the amount of internal volume on the suction side of the accumulator-dehydrator. The magnitude and occurrence of noise is dependent on the total energy imparted to the accumulator-dehydrator, and the extent of accumulator-dehydrator isolation. All noise is unpleasant to the occupants of the vehicle. A smoother running and quieter air conditioning system is much more appealing to the occupants. This bump energy and the associated noise occur to some degree in all current J-tube accumulator-dehydrators.

Some attempts have been made to try to eliminate this bump energy by eliminating the traditional J-tube that fills with liquid. An example of an accumulator-dehydrator eliminating the traditional J-tube and replacing the traditional J-tube with a tube that does not fill with liquid is shown in U.S. Pat. No. 4,331,001. In this system, the traditional J-tube is replaced with an extended outlet fitting mounted within a desiccant. In this system all of the vapor in the accumulator-dehydrator is pulled through the desiccant. Because of the amount of suction required to pull the vapor through the desiccant there is a very large pressure drop across the accumulator-dehydrator. The large pressure drop that occurs makes the accumulator-dehydrator inefficient as well as making the entire air conditioning system less efficient, which can lead, to decreased life of the air conditioning components. This unit also is a more complicated design with additional parts, making the unit more expensive to manufacture.

SUMMARY OF THE INVENTION

The accumulator-dehydrator of the present invention contains an inline trumpet tube that does not fill with liquid while the compressor is disengaged. The inline trumpet tube may or may not have a pressure equalization hole (PEH) through the wall of the trumpet tube and a restricted flow diameter in the middle of the tube. Attached to the bottom of the inline trumpet tube is an oil pick up tube with the restricted flow diameter at the location where the oil pick up tube attaches to the trumpet tube. The restricted flow diameter produces a venturi effect that is designed to create a pressure differential across the oil pick up tube. This pressure differential drives a small portion of the oil and refrigerant liquid from the bottom of the canister, up through the pick up tube, and into the outlet vapor flow. This small portion of liquid provides lubrication and cooling for the compressor. At the bottom of the oil pick up tube is a filter. The inline trumpet tube also contains an anti-siphon feature through the use of the PEH (pressure equalization hole). The PEH equalizes the pressure in the trumpet tube with that in the canister. This insures that if liquid does accumulate in the trumpet tube, it will not be pulled into the compressor by refrigerant migration. Refrigerant migration occurs while the compressor is disengaged or off. In the preferred embodiment, the inline trumpet tube has a trumpet shaped end, which is flared to at least 30 degrees with respect to vertical as illustrated in FIG. 1. This trumpet shaped end opens upwards towards the top of the canister.

Because the vapor portions of the refrigerant and oil do not have to be pulled through the desiccant, nor through the U-shaped portion of the current J-tube, the pressure drop is significantly decreased. This design also allows the accumulator-dehydrator to work much more efficiently because of reduced pressure drop and therefore the entire air conditioning system performs more efficiently.

BRIEF DESCRIPTION OF THE DRAWINGS

Advantages of the present invention will be readily appreciated, as the same becomes better understood by reference to the following detailed description when considered in connection with the accompanying drawing wherein.

DESCRIPTION OF THE PREFERRED EMBODIMENT

Figure 1:
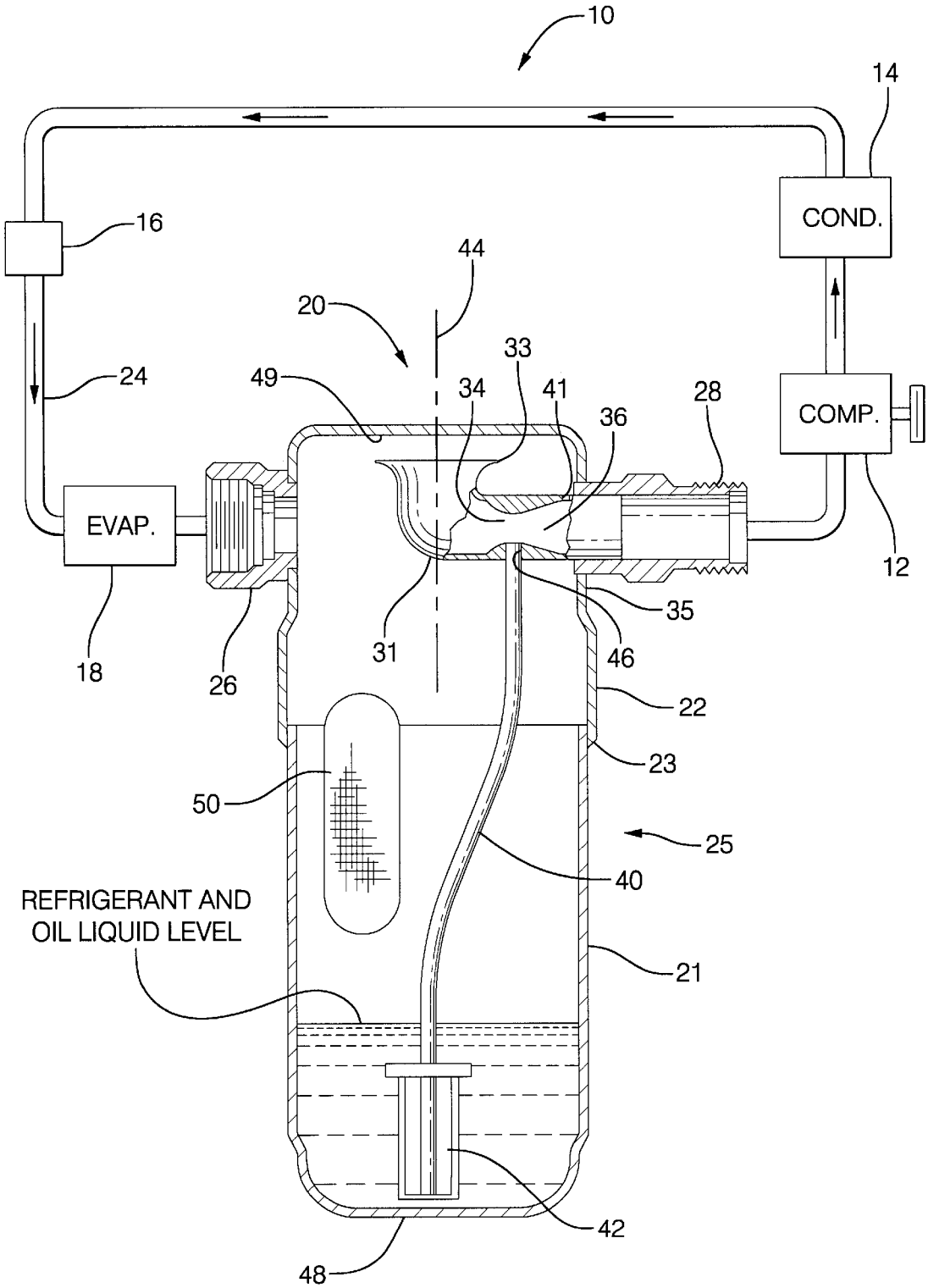
FIG. 1 shows a cross section of the accumulator-dehydrator of the present invention.

Referring to FIG. 1, there is generally shown at 10 a vehicle air conditioning system which includes a compressor 12 that compresses and superheats refrigerant, after which the super heated refrigerant then runs through a condenser 14 where heat transfer takes place as the superheated refrigerant gas turns to sub-cooled liquid, then on to an expansion device 16 wherein the pressure is reduced and then to the evaporator 18 wherein a heat transfer again takes place to cool the surrounding environment before returning to the compressor 12 to begin the cycle again. Mixed in with the refrigerant is a small amount of lubricating oil entrained within the refrigerant which is needed to ensure smooth performance and prolong the life of the compressor 12.

Shown generally at 20 and interposed between the evaporator 18 and compressor 12 is an accumulator-dehydrator 20, which is designed to accomplish several objectives. The accumulator-dehydrator 20 primarily receives and accumulates the evaporator 18 effluent. The evaporator 18 effluent typically includes both a liquid component and a vapor component. The liquid component includes both liquid refrigerant and oil, and the vapor component is vaporized refrigerant. The accumulator-dehydrator 20 serves as a reservoir or separator in which liquid collects at the bottom 48 of the reservoir and vapor at the top 49. The accumulator-dehydrator 20 ensures that only refrigerant in a vapor state and entrained oil passes to the compressor 12. The accumulator-dehydrator 20 also prevents a liquid slug from being pulled or sucked into the compressor 12.

The accumulator-dehydrator 20 as illustrated includes a two piece canister 25 having cup-shaped members 21,22 sealingly joined by an annular weld 23. Inlet 26 and outlet fittings 28 are attached to the side wall 35 of the canister 25 toward the top 49 of the canister 25 at diametrically opposite locations. This spatial relationship between the inlet and outlet fittings 26,28 is shown in the illustrated embodiment, but is not required to practice the invention.

A hollow delivery tube or trumpet tube 31 with a flared end 33 is connected to the outlet fitting 28. In the preferred embodiment, the flared end 33 is flared to at least 30 degrees with respect to the longitudinal centerline 44 of the accumulator-dehydrator 20. The flared end 33 is beneficial to prevent inadvertent drawing of oil or liquid refrigerant into tube 31. Inline trumpet tube 31 is different from typical J-tubes in that no liquid collects in the trumpet tube 31. Trumpet tube 31 contains a central vapor passage 36 in which vaporous refrigerant is pulled through tube 31. Inline trumpet tube 31 also has a first restricted flow orifice 34 located approximately in the middle of the trumpet tube 31. The restricted flow orifice 34 creates a venturi effect, which creates a pressure differential across the oil pick up tube, 40 that provides the suction to pull a small portion of liquid refrigerant and oil into the outlet vapor flow needed to prolong compressor life.

Trumpet tube 31 may or may not include a pressure equalization hole 41. Pressure equalization hole 41 is preferably located between the restricted flow orifice 34 and the sidewall 35 of canister 25. The pressure equalization hole 41 equalizes the pressure in the trumpet tube with that in the canister. This insures that if liquid does accumulate in the trumpet tube, it will not be pulled into the compressor by refrigerant migration.

The flared end 33 of the trumpet tube 31 is positioned at approximately the interior center of the canister 25. The flared end 33 is shown in the illustrated embodiment in a central position, but such a position is not necessary to practice the invention. To collect liquid (refrigerant and oil) in the bottom 48 of the canister 25, an oil pick up tube 40 is provided which extends from the tube 31 to adjacent the bottom 48 of canister 25. A filter screen assembly 42 is mounted on the lower end of the oil pick up tube 40 about its open inlet end and serves to screen out any foreign matter. It is to be understood that the lower end of the oil pick up tube 40 and the filter screen assembly 42 are below the refrigerant and oil level in the bottom 48 of the canister 25. The upper end of the oil pick up tube 40 (its outlet end) is connected to the trumpet tube 31 at the flow orifice 46. As a result, a venturi effect is induced over the outlet of the oil pick up tube 40 which induces liquid refrigerant and oil flow up through the liquid passage provided by the oil pick-up tube 40. As liquid refrigerant and oil passes through the oil pick up tube outlet 40, the refrigerant and the oil becomes entrained in the outlet refrigerant vapor flow. Still further, a desiccant 50 is typically located in the bottom of the accumulator-dehydrator 20 to absorb any water in the refrigerant.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An accumulator-dehydrator for use in an air conditioning system having an evaporator and compressor interconnected by a refrigerant line containing refrigerant, said accumulator-dehydrator comprising:

a canister having an upper portion and a lower portion, said lower portion being adapted to contain liquid refrigerant and oil from said refrigerant line and said upper portion being adapted to contain vaporized refrigerant, said canister having an inlet connected to said evaporator through said refrigerant line and an outlet connected to said compressor through said refrigerant line;

a hollow delivery tube having first and second ends, said first end being unobstructed and positioned within the upper portion of said canister to draw in vaporized refrigerant, said second end being connected to said outlet to deliver vaporized refrigerant and entrained oil to said compressor, said delivery tube having a venturi portion defined by a restricted flow orifice;

an oil pickup tube for drawing liquid refrigerant and oil from said lower portion into said delivery tube, said oil pickup tube being in operative communication with said delivery tube, said venturi portion drawing in the liquid refrigerant and oil and entraining said liquid refrigerant and oil in the vaporized refrigerant outlet flow of said delivery tube.

2. The accumulator-dehydrator of claim 1, wherein said first end of said hollow delivery tube has a flared end.

3. The accumulator-dehydrator of claim 2, wherein said flared end is flared to about 30 degrees with respect to the longitudinal centerline of said accumulator-dehydrator.

4. The accumulator-dehydrator of claim 1, wherein vaporized refrigerant flows in a flow path from said first end through said second end defining a downstream flow path from said first end to said second end, and an upstream flow path from said second end to said first end.

5. The accumulator-dehydrator of claim 4, wherein said venturi portion is over said oil pickup tube and downstream of said first end.

6. The accumulator-dehydrator of claim 4, further including a pressure equalization hole in said hollow delivery tube, said pressure equalization hole is downstream of said venturi portion.

7. The accumulator-dehydrator of claim 6, wherein said pressure equalization hole is downstream of said oil pickup tube.

8. An accumulator-dehydrator for use in an air conditioning system having an evaporator and compressor interconnected by a refrigerant line containing refrigerant, said accumulator-dehydrator comprising:

a canister having an upper portion and a lower portion, said lower portion being adapted to contain liquid refrigerant and oil from said refrigerant line and said upper portion being adapted to contain vaporized refrigerant, said canister having an inlet connected to said evaporator through said refrigerant line and an outlet connected to said compressor through said refrigerant line;

a hollow delivery tube having first and second ends, said first end being unobstructed and positioned within the upper portion of said canister to draw in vaporized refrigerant, said second end being connected to said outlet to deliver vaporized refrigerant and entrained oil to said compressor, said delivery tube having a venturi portion;

an oil pickup tube for drawing liquid refrigerant and oil from said lower portion into said delivery tube, said oil pickup tube being in operative communication with said delivery tube, said venturi portion drawing in the liquid refrigerant and oil and entraining said liquid refrigerant and oil in the vaporized refrigerant outlet flow of said delivery tube; and a pressure equalization hole in said hollow delivery tube.

9. The accumulator-dehydrator of claim 8, wherein said pressure equalization hold is adjacent said oil pickup tube adjacent said outlet.

10. The accumulator-dehydrator of claim 8, wherein said pressure equalization hole is downstream of said oil pickup tube.

* * * * *